United States Patent [19]

Bell

[11] Patent Number: 4,651,898

[45] Date of Patent: Mar. 24, 1987

[54] MILK DISPENSER

[76] Inventor: Michael Bell, Box 65755, Station "F", Vancouver, British Columbia, Canada, V5N 5K7

[21] Appl. No.: 680,720

[22] Filed: Dec. 12, 1984

[30] Foreign Application Priority Data

Feb. 13, 1984 [CA] Canada ..... 447298

[51] Int. Cl.[4] ..... B65D 37/00

[52] U.S. Cl. ..... 222/129; 222/213; 222/214; 251/7

[58] Field of Search ..... 222/212, 211, 213, 214, 222/215, 107, 105, 206, 94, 92, 129, 207, 556, 561; 251/6, 7

[56] References Cited

U.S. PATENT DOCUMENTS

| | | | |
|---|---|---|---|
| 1,686,003 | 10/1928 | Hottinger | 251/6 |
| 2,872,078 | 2/1959 | Kennedy | 251/7 |
| 3,089,622 | 5/1963 | Westlake, Jr. | 222/214 |
| 3,881,641 | 5/1975 | Pliml, Jr. et al. | 222/213 |
| 4,240,565 | 12/1980 | Croley | 222/105 |

FOREIGN PATENT DOCUMENTS

| | | |
|---|---|---|
| 79730 | 1/1903 | Canada . |
| 866653 | 3/1971 | Canada . |
| 891367 | 1/1972 | Canada . |
| 974145 | 9/1975 | Canada . |

*Primary Examiner*—Joseph J. Rolla
*Assistant Examiner*—Kenneth Noland
*Attorney, Agent, or Firm*—Armstrong, Nikaido, Marmelstein & Kubovcik

[57] ABSTRACT

A system for dispensing simultaneously into a single receptacle milk from different sources in a milk dispensing cabinet. The cabinet comprises two adjacent compartments for different milk containers. Each container has a flexible outlet tube for the milk contained therein. The cabinet has a milk dispenser outlet controller comprising a channel defined by walls, which channel is normally vertically oriented and through which channel the outlet tubes from each milk container pass. The tubes are positioned a similar distance with respect to one of the walls of the channel. A pinch valve, having a surface parallel to that wall, is positioned on the opposite side of the tubes with respect to that wall. Its surface is movable in parallel fashion with respect to the wall to permit simultaneous opening or closing of the flow of milk through the tubes. When one of the milk container contains reconstituted powdered skim milk, the combined milk mixture dispensed into a glass by the system according to the present invention provides an economical, palatable milk substitute which can afford considerable savings for institutions.

8 Claims, 3 Drawing Figures

MILK DISPENSER

The present invention relates to a commercial milk dispenser system which provides palatable milk by dispensing simultaneously into a receptacle a combination of homogenized milk and reconstituted powdered skim milk.

BACKGROUND OF THE INVENTION

It is well known that a palatable milk substitute can be obtained by combining homogenized fluid milk and powdered skim milk. Such a combined product produces considerable savings, since an equal volume of powdered skim milk is significantly cheaper than homogenized, 2% or skim milk. While in a home environment there is no problem in blending powdered skim milk with homogenized fluid milk to produce such a palatable whole milk substitute, problems develop in applying this practice to large scale institutions. Essentially labour costs eliminate the cost savings which will otherwise result. As well, there is not, in the marketplace today, an efficient sanitary method of mixing such milk.

At the present time, for large scale institutional use, about the only way of producing such a palatable milk substitute is to mix the powdered skim milk and water in proper proportions in a pail, portion the resultant mixture and add homogenized or 2% milk.

There is presently available for commercial use in the marketplace powdered milk in a twenty liter capacity bag having a flexible outlet tube adaptable to commercial milk dispensers. The purchaser simply fills the bag with water prior to use. This eliminates the necessity of measuring water or powder, since the powder is in the right proportion in the bag for the size of the bag.

Conventional gravity flow milk dispensers consist of insulated cabinets within which, usually, either a single or double compartment for holding milk is found. A front door provides access to the compartment or compartments within which one or more milk containers sit. In one form of such a milk dispenser, one or more cages sit within the compartment, each to hold, for example, a twenty liter milk bag having a flexible outlet tube at its bottom. A single liquid outlet controller having a mechanism for pinching the outlet tube from the milk bag within, is positioned in front of each compartment on the outside of the milk dispenser cabinet. The valve is handle operated so that the consumer, by manipulating the handle, obtains the desired amount of milk in a glass or other receptacle positioned beneath that tube outlet. In double compartment dispensers, two such outlet controllers are provided, one for each container or cage. Milk is dispensed under gravity flow.

Examples of outlet tube controllers for example used in dispensing fluids through flexible tubes are described in Canadian Pat. No. 79,730 of Horsey issued Mar. 24, 1903; Canadian Pat. No. 866,653 of Cross issued Mar. 23, 1971; Canadian Pat. No. 891,367 of Norris issued Jan. 25, 1972; and Canadian Pat. No. 974,145 of Thompson issued Sept. 9, 1975.

If such a commercial double milk dispenser were used in a manner such that homogenized milk was placed in one compartment and reconstituted skim milk placed in the other, the person dispensing could then fill half a glass or receptacle from each side and mix with a spoon or utensil. Such a method however would lack consistency and relies for its success on the judgement of the person operating the machine to ensure that proper proportions are mixed. As well, problems of convenience and sanitation arise in such a method.

It is an object of the present invention to provide an improved commercial milk dispensing system which will enable a palatable combination of reconstituted powdered skim milk, and homogenized milk, to be provided in a receptacle. While the invention has broader application than milk, and may be used for dispensing a mixed blend of other fluids, the invention will be described primarily in the context of milk dispensers. It is of course not intended to limit the scope of the invention to milk dispensers.

SUMMARY OF THE INVENTION

According to the present invention there is provided a system for dispensing under gravity two liquids simultaneously from two independent sources in a holding cabinet. The cabinet has two adjacent compartments, one compartment for holding a container for one of the liquids and the other compartment for holding a container of the other of the liquids. Each container has positioned near its bottom a flexible outlet tube for the liquid contained therein and each compartment has a platform on which the respective container sits. The cabinet also provides a liquid dispenser outlet controller comprising a channel defined by walls. Within that channel the outlet tubes from each liquid container pass. A retainer means is associated with the channel to maintain the positioning of the tubes within the channel a similar distance with respect to one of the walls of the channel. The controller also has a tube pinch valve with a surface parallel to that wall of the channel and positioned on the opposite side of the tubes with respect to that wall. This valve is movable by the operator to move the pinch valve surface in parallel fashion with respect to that wall between a position proximate to, but spaced from the wall to pinch off simultaneously the flow of liquid through the tubes and a position more distant from the wall which permits simultaneous flow of liquid through each of the tubes. In particular, the system according to the present invention provides an economical, efficient and effective method of dispensing, from a commercial, double milk dispenser cabinet, a properly blended mixture of reconstituted powdered skim milk and homogenized milk.

BRIEF DESCRIPTION OF THE DRAWINGS

These and other objects and advantages of the present invention will become apparent upon reading the following detailed description and upon referring to the drawings in which.

Figure 1:
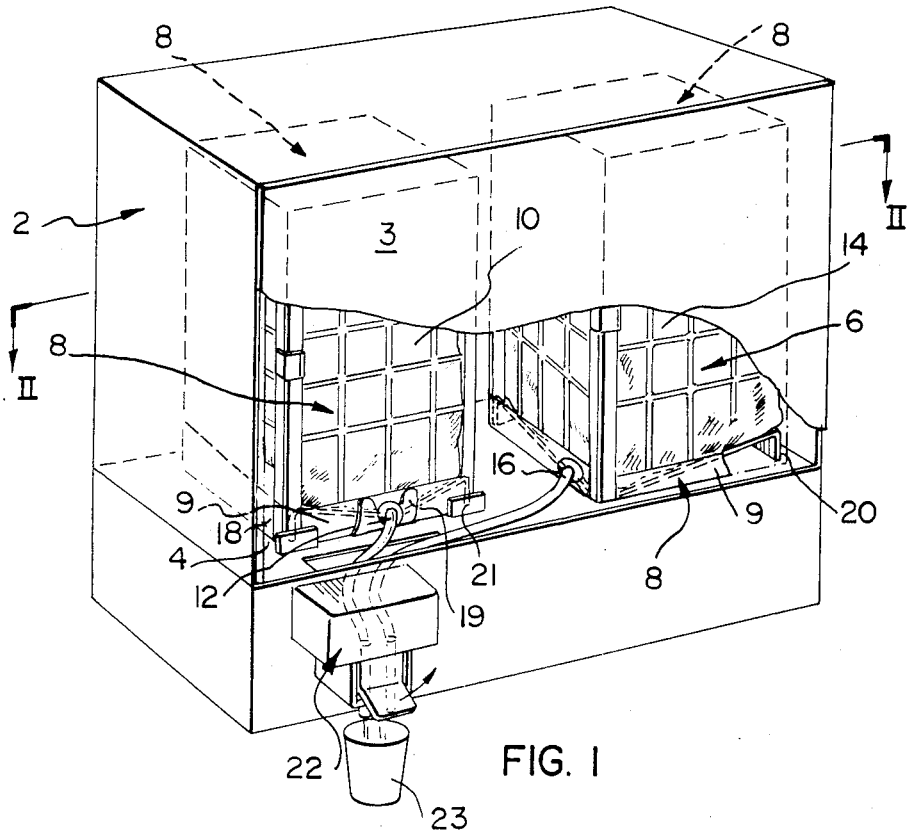
FIG. 1 is a perspective view of a milk dispenser according to the present invention.

While the invention will be described in conjunction with an example embodiment it will be understood that it is not intended to limit the invention to such embodiment. On the contrary, it is intended to cover all such alternatives, modifications and equivalents as may be included within the spirit and scope of the invention as defined by the appended claims.

DETAILED DESCRIPTION OF THE INVENTION

In the following description, similar features in the drawings have been given similar reference numerals.

Turning to FIG. 1 there is shown a commercial milk dispensing cabinet 2 of a standard type, having a door 3 which opens to provide access internally to compartments 4 and 6. These compartments may be separated by an inner wall or may simply be two parts of one large interior volume of the cabinet 2. In compartments 4 and 6 are seated cages 8 having doors 9 providing access within, for holding, for example, twenty liter bags of milk. In the illustrated embodiment, in one of the cages is a bag 10 of homogenized milk with an outlet tube 12 positioned near its bottom; in the other is bag 14 of reconstituted powdered skim milk with its outlet tube 16. These bags are for example, of twenty liter capacity. Homogenized milk bag 10 sits on a platform 18, within its cage 8 while skim milk bag 14 sits on platform 20. These platforms are specifically contoured in a manner which will be described in more detail hereinafter.

Outlet tubes 12 and 16 are directed towards milk dispenser outlet controller 22 which is illustrated as being located in the usual position of one of the milk outlet valves of a standard cabinet, for ease of manufacture, to minimize the modifications required to adapt conventional milk dispensers to the present invention. It will be understood that controller 22 might alternatively be centrally positioned at the front of cabinet 2 between the compartments 4 and 6 if a cabinet 2 were constructed exclusively for use according to the present invention. The positioning of milk outlet dispenser 22 dictates the construction of platforms 18 and 20. Since milk flows from bags 10 and 14 under gravity flow, it is desired, for maximum economy and to ensure full drainage of the bags, to have the floor of platform 18 slanted downwardly from back to front, inwardly from the sides, to direct the flow of milk to the bottom central front part of the bottom of cage 8, immediately in front of controller 22. Similarly, for platform 20, it is desirable to have the platform sloped from the outer side to the inner side, towards controller 22, and again from back to front. As well, because of the location of controller 22, outlet tube 16 is secured to bag 10 at its bottom front central location, and at the bottom front left hand location for bag 14.

Platform 18, behind controller 22 is optional. Excellent results in draining bag 10 without that platform have been obtained when outlet tube 12 from bag 10 is held as it leaves cage 8 in a collar 19 centrally positioned with respect to cage 8, this collar ensuring proper positioning and orientation of tube 12 as it leave the cage for unobstructed and complete flow of milk from this bag 10.

Figure 2:
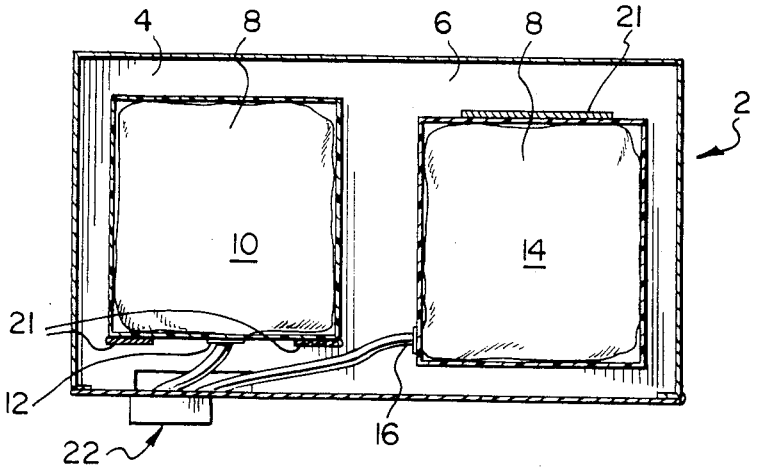
FIG. 2 is a top plan section view along line II—II of FIG. 1.

As can be seen in the plan view of FIG. 2, positioners 21 inside compartments 4 and 6 ensure the proper positioning of cages 8 containing milk bags 10 and 14, to ensure that their outlet tubes 12 and 16 respectively are not obstructed and can pass directly to outlet dispenser controller 22.

The construction of outlet dispenser controller 22, designed as it is to permit similar and simultaneous flow through tubes 12 and 16 into a common receptacle 23, has required considerable time and effort in development. The prior art controller valves previously referred to herein, while adequate for controlling the flow through a single valve, are not adapted to control the simultaneous flow of fluid through multiple tubes in a manner which would be effective for application in the present invention. The controller of the present invention must allow approximately equal simultaneous flow of the two different milk products through the flexible tubes 12 and 16, to result in a desired composition and consistency in the product flowing into receptacle 23 below controller 22. Adaptations of standard commercial handle operated single tube controllers to control the flow through two tubes has resulted in leaking and uneven operation of such modified devices. To prevent such leaking, forces in the mechanisms of such controllers were required which made the handles difficult to operate. Moreover uneven flow, resulting in improper consistency of the product dispensed, resulted.

Figure 3:
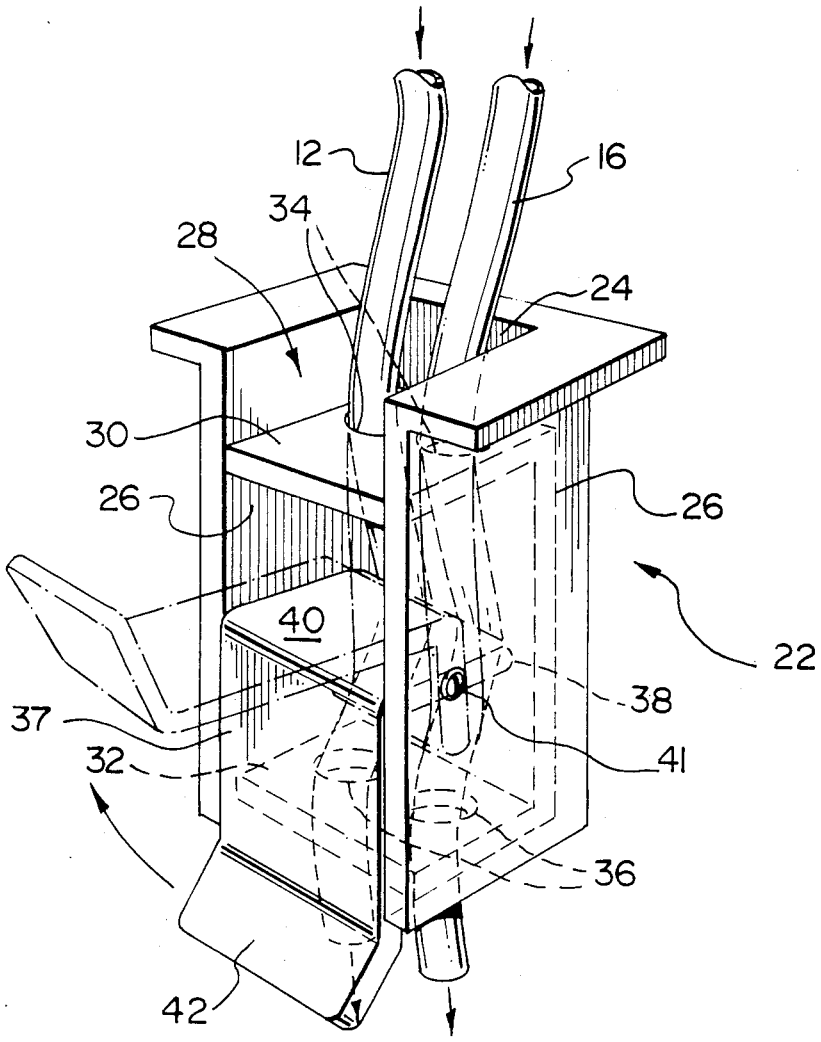
FIG. 3 is an enlarged detail view in perspective of the outlet controller of FIG. 1.

As a result of these problems with modified controllers, the double outlet dispenser controller 22, more clearly detailed in FIG. 3 was developed. Controller 22 comprises a back wall 24 and side walls 26 defining a channel 28 through which outlet tubes 12 and 16 pass. A pair of generally horizontal retainers or retaining platforms 30 and 32, having respectively pairs of apertures 34 and 36, are spaced within channel 28, the apertures being vertically aligned in side-by-side relationship parallel to the back wall 24 of channel 28 to receive tube outlets 12 and 16 and maintain them, within that channel, a similar distance with respect to back wall 24. The controller is also provided with a movable pinch valve 37, the pinch valve comprising a bearing surface 38 at the rear of panel 40, which panel is pivotably secured between tube retainers 30 and 32 at 41. Bearing surface 38 extends more or less across channel 28 and, when in closed position as illustrated, is proximal to, but spaced from back wall 24 to similarly squeeze outlet tubes 12 and 16 against back wall 24 and stop the flow of milk through them. When panel 40 is in open position, as shown in phantom in FIG. 1, bearing surface 38 has been pivoted downwardly off of and away from tube outlets 12 and 16, and away from back wall 24, to result in similar, simultaneous flow of milk through each outlet tube (assuming, of course, milk bags 4 and 6 are of similar size and filled to a similar degree and tubes 12 and 16 are of a similar cross-sectional size, so that the pressure of fluid in outlet tubes 12 and 16 is similar). It will be noted that bearing surface 38 is bevelled. This is to facilitate the pivoting into closing position and pivoting out of that position of the bearing surface with respect to tubes 12 and 16.

Handle 42 is secured to the front end of panel 40 so that the panel and plane of handle 42 are normal to each other, handle 42 acting as a lever to facilitate movement of panel 40 and its bearing surface 38 into closed position pinching shut tubes 12 and 16 against back wall 24, and out of that position.

It should be noted that back wall 24 of channel 28, against which the tubes are pinched by bearing surface 38, is flat and generally vertically oriented during operation, while bearing surface 38 remains in horizontal position, parallel to that bearing surface, during its pivotal operation.

The system according to the present invention provides a mechanism for restraining the tubes side-by-side, such that when bearing surface 38 is opened any amount with respect to the tube outlets 12 and 16 and back wall 24, milk drains evenly through these tubes. The user can fill glasses and smaller jugs with fluid milk which is sufficiently mixed in the glass simply as a result of the simultaneous flow of milk from the two outlet tubes into the glass or other container. As well, the construction according to the present invention provides adequate leverage to ensure complete squeezing shut of the tube outlets as required with little or no subsequent leaking. The inside surface of handle 42, as can be seen in FIG. 3, bears against the forward surface of lower retainer 30, to act as a stop when bearing surface 38 is in closed position bearing against and squeezing off the flow of milk through the two tube outlets. Both the design and operation of the device according to the present invention are simple, allowing the system to have practical application in institutions such as hospitals, where there are many staff, training time is expensive, and many of the staff are semi-skilled.

Thus there has been provided in accordance with the invention a system for dispensing simultaneously into a single receptacle milk (or other liquids) from two independent, different sources in a milk (or liquid) dispensing cabinet that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention:

1. A system for dispensing under gravity two liquids simultaneously from two independent sources in a holding cabinet, the cabinet having two adjacent compartments, one compartment for holding a container for one of the liquids and the other compartment for holding a container of the other of the liquids, each container having positioned near its bottom a flexible outlet tube for the liquid contained therein, each compartment having a platform on which the respective container sits, the cabinet having a liquid dispenser outlet controller comprising (1) a channel defined by walls and within which channel the outlet tubes from each liquid container pass, the channel having side and back walls which, during normal operation, are vertically oriented and have a U-shaped transverse cross-section in a horizontal plane, (2) a tube pinch valve having a surface parallel to the back wall of the channel, which wall is positioned on the opposite side of the tubes with respect to the pinch valve, this valve being movable by the operator to move the pinch valve surface in parallel fashion with respect to the back wall between a position proximal thereto, but spaced from the wall to pinch off simultaneously the flow of liquid through the tubes and a position more distant from that wall which permits simultaneous flow of liquid through each of the tubes, and (3) a tube retainer forwardly extending below the pinch valve surface from a lower portion of the back wall, the retainer having a pair of tube retaining apertures positioned side-by-side therein, each to receive an outlet tube therein without restricting the flow of fluid, the tube retainer to maintain the positioning of the tubes within the channel a similar distance with respect to the back wall of the channel.

2. A system according to claim 1 for dispensing milk, wherein the holding cabinet is a commercial milk dispenser cabinet, one of the compartments of the cabinet being for a whole milk container and the other for a container of reconstituted powdered skim milk.

3. A system according to claim 2 wherein the milk dispenser outlet controller is centred in front of one of the compartments and the platform on which the container for that compartment sits is contoured to slope from back to front and from the sides inwardly, towards that outlet controller, and the platform of the other compartment is contoured to slope from back to front and from one side towards the side which is proximal to the other compartment, whereby milk may be drained from containers in the compartments through the outlet tubes in the milk containers, under gravity flow.

4. A system according to claim 1 wherein the retainer means associated with the channel maintains the tubes within the channel a similar distance with respect to the back wall of the channel.

5. A system according to claim 4 wherein the pinch valve comprises a bearing surface pivotable when manipulated by handle means, about a horizontal axis parallel to the back wall of the channel between closed position pinching the tubes against the back wall of the channel and open position spaced away therefrom.

6. A system according to claim 1 wherein the pinch valve comprises a bearing surface pivotable when manipulated by handle means, about a horizontal axis parallel to the back wall of the channel between closed position pinching the tubes against the back wall of the channel and open position spaced away therefrom.

7. A system according to claim 6 further provided with a tube retainer forwardly extending above the pinch valve surface from an upper portion of the back wall, this tube retainer having a pair of tube retaining apertures positioned side-by-side therein and vertically aligned with those of the other tube retainer below it, each to receive an outlet tube therein without restricting the flow of fluid, the surface of the pinch valve positioned and normally operational between the two tube retainers.

8. A system according to claim 5, 6 or 7 wherein at least an edge portion of the bearing surface is rounded in a manner to facilitate movement of the surface into and away from pinching position with respect to the flexible tubes and back wall.

* * * * *